United States Patent [19]

Castonguay et al.

[11] Patent Number: 4,978,816

[45] Date of Patent: Dec. 18, 1990

[54] CIRCUIT BREAKER HANDLE INTERLOCK ARRANGEMENT

[75] Inventors: Roger N. Castonguay, Terryville; Robert A. Morris, Burlington, both of Conn.

[73] Assignee: General Electric Company, New York, N.Y.

[21] Appl. No.: 481,012

[22] Filed: Feb. 16, 1990

[51] Int. Cl.[5] ..... H01H 9/28

[52] U.S. Cl. ..... 200/43.14; 70/203; 70/DIG. 30; 200/43.22; 200/43.15

[58] Field of Search ..... 200/43.01, 43.15, 43.14, 200/43.19, 43.22, 302.3; 70/202, 203, DIG. 30; 74/526, 483 R, 483 K

[56] References Cited

U.S. PATENT DOCUMENTS

| | | | |
|---|---|---|---|
| 1,444,379 | 2/1923 | Jones | 70/202 |
| 1,801,228 | 4/1931 | Edhlund | 200/43.22 |
| 2,169,860 | 8/1939 | Von Hoorn | 70/203 |
| 2,265,438 | 12/1941 | Marple | 200/43.22 |
| 3,024,337 | 3/1962 | Goody et al. | 200/43.22 |
| 3,055,995 | 9/1962 | Snow | 200/43.15 |
| 3,096,409 | 7/1963 | Hubbell et al. | 200/43.22 |
| 3,291,924 | 12/1966 | Thorp | 200/43.15 |
| 3,595,040 | 7/1971 | Curl | 70/203 |
| 4,160,137 | 7/1979 | Clement et al. | 200/43.15 |
| 4,260,861 | 4/1981 | DiMarco | 200/42 |
| 4,347,412 | 8/1982 | Mihara et al. | 70/203 |
| 4,467,152 | 8/1984 | Gordy | 70/203 |
| 4,733,029 | 3/1988 | Kobayashi et al. | 200/43.15 |
| 4,754,247 | 6/1988 | Raymont et al. | 335/202 |
| 4,882,456 | 11/1989 | Hovanic et al. | 200/43.15 |

FOREIGN PATENT DOCUMENTS

| | | | |
|---|---|---|---|
| 677653 | 1/1964 | Canada | 200/43.14 |
| 2152286 | 7/1985 | United Kingdom | 200/43.19 |
| 2208454 | 3/1989 | United Kingdom | 200/43.15 |

*Primary Examiner*—Henry J. Recla
*Assistant Examiner*—Glenn T. Barrett
*Attorney, Agent, or Firm*—Richard A. Menelly; Walter C. Bernkopf; Fred Jacob

[57] ABSTRACT

A handle interlock arrangement is attached to the top surface of a manually operable circuit breaker operating handle to prevent the handle from being locked in its "OFF" position when the circuit breaker contacts are actually in their closed condition. A handle cover is hingeably attached to the circuit breaker cover and includes a pair of apertures arranged through the opposite sidewalls of the cover. The location of the apertures relative to the circuit breaker operating handle prevents the insertion of a padlock through the apertures when the circuit breaker operating handle is in its "ON" position.

16 Claims, 3 Drawing Sheets

10

CIRCUIT BREAKER HANDLE INTERLOCK ARRANGEMENT

BACKGROUND OF THE INVENTION

Industrial-rated circuit breakers such as those described in U.S. Pat. No. 4,754,247, which Patent is incorporated herein for reference purposes, are often times mounted within an electrical enclosure that is remote from the protected electrical equipment. When the electrical equipment is shut down for maintenance and repair, the associated circuit breaker is turned to its OFF condition and some type of interlock means is generally employed to prevent the circuit breaker from being inadvertently turned to its ON condition.

U.S. Pat. No. 3,595,040 describes a handle lock attachment whereby a padlock is employed to ensure that the circuit breaker operating handle remains in a fixed position.

U.S. Pat. No. 2,169,860 describes the use of a circuit breaker guard member and locking bar to prevent access to the circuit breaker handle or to the attachment means for holding the padlock support to the circuit breaker cover.

U.S. Pat. No. 4,882,456 utilizes a pair of upstanding flanges one on either side of a circuit breaker operating handle having a pair of apertures aligned with an aperture in the circuit breaker handle for preventing movement of the handle.

In those rare instances where the short circuit current through the protected circuit exceeds the rating of the associated circuit breaker, the circuit breaker contacts can become welded in their closed position by the intense heat generated at the interface between the opposing contact surfaces. The so-called "welded contact" condition prevents the circuit breaker operating handle from remaining in its "OFF" position by the return bias provided by the circuit breaker operating mechanism springs. Although the handle can be manually moved to its "OFF" position, the handle readily returns to its "ON" position upon release thereof. Should the operating handle be moved to its "OFF" position and secured by means of a padlock such as described in the aforementioned U.S. Patents, the "OFF" position of the operating handle mistakenly infers that the circuit breaker contacts are separated when they are, in fact, welded together in their closed condition.

One purpose of this invention is to provide a circuit breaker handle interlock arrangement whereby the circuit breaker handle can only be locked in its OFF position when the circuit breaker contacts are actually separated.

SUMMARY OF THE INVENTION

A circuit breaker handle interlock arrangement consists of a handle support base that is attached to the top surface of a circuit breaker. The support includes an upstanding locking hasp along with a pivotally-mounted handle cover including a pair of apertures that are aligned with each other and with the locking hasp. When the circuit breaker contacts are separated, the circuit breaker operating handle is locked in its OFF position by means of a padlock arranged through the apertures and through the locking hasp. When the circuit breaker contacts are in their closed position, the operating handle interferes with the insertion of the padlock through the apertures and the locking hasp and thereby prevents the circuit breaker operating handle from being locked in an "ON" position.

DESCRIPTION OF THE PREFERRED EMBODIMENT

Figure 1:
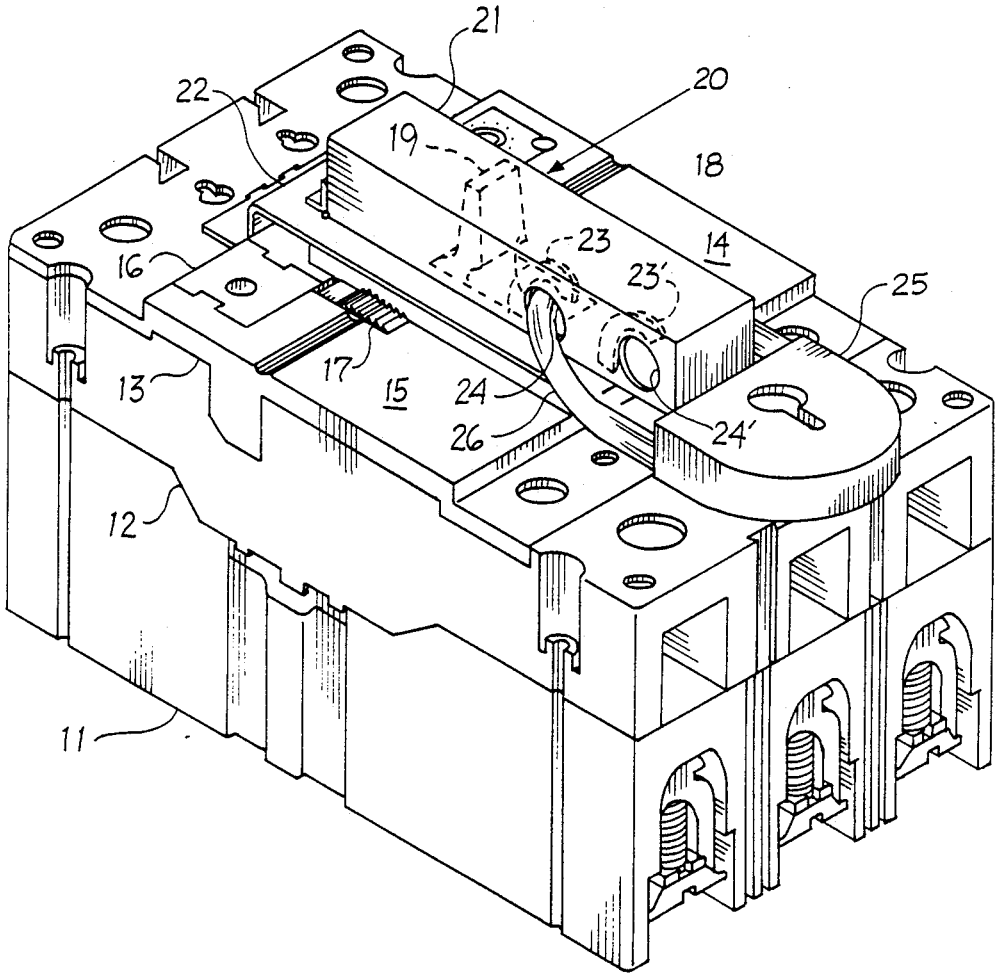
FIG. 1 is a top perspective view of an industrial-rated circuit breaker containing the handle interlock arrangement according to the invention.

An industrial-rated circuit breaker 10 is shown in FIG. 1 to consist of a case 11, cover 12 and an accessory cover 13 as fully described in aforementioned U.S. Pat. No. 4,754,247. The accessory cover provides access to a pair of accessory doors 14, 15 to underlying compartments that contain the circuit breaker trip actuator and an associated accessory device. A rating plug 16 is inserted within a separate recess within the accessory cover to set the circuit breaker rating. The test button 17 allows the circuit breaker operating mechanism to be articulated manually for test purposes. A viewing window 18 (FIG. 2) on the opposite side of the circuit breaker operating handle 19 allows the conditions of the circuit breaker contact to be visually determined. An interlock system 20 consisting of a handle cover or shroud 21 prevents access to the operating handle and is hingeably attached to the circuit breaker cover by means of the support base 22. A locking hasp 23 is upstandingly supported on the support base and is arranged in alignment with a pair of apertures one of which is depicted at 24 through the sidewalls of the operating handle cover. A padlock 25 is arranged such that the padlock arm 26 extends through the apertures and the locking hasp to prevent access to the circuit breaker operating handle.

Figure 2:
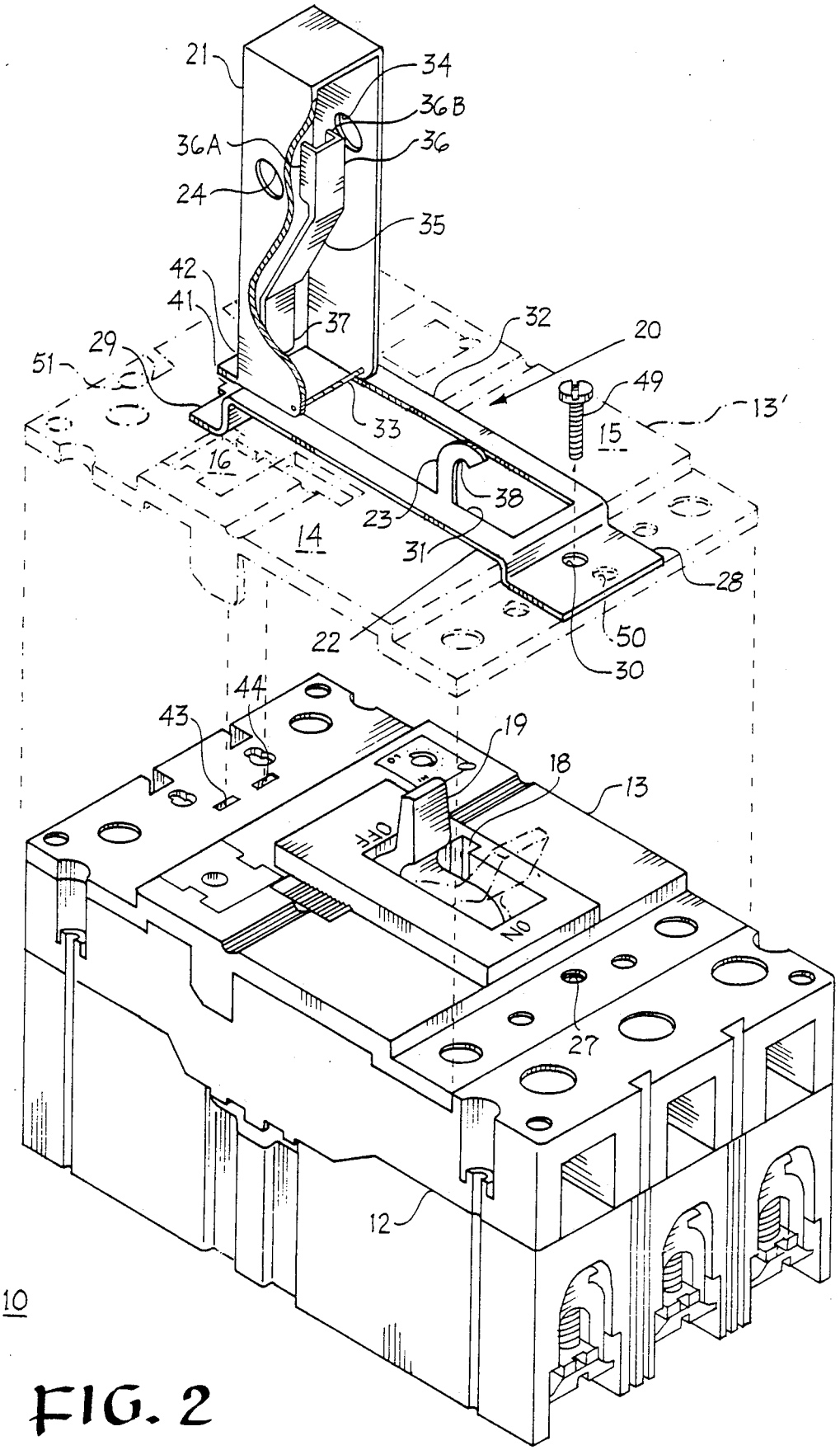
FIG. 2 is a top perspective view of the circuit breaker of FIG. 1 prior to attachment of the handle interlock arrangement.
Figure 3:
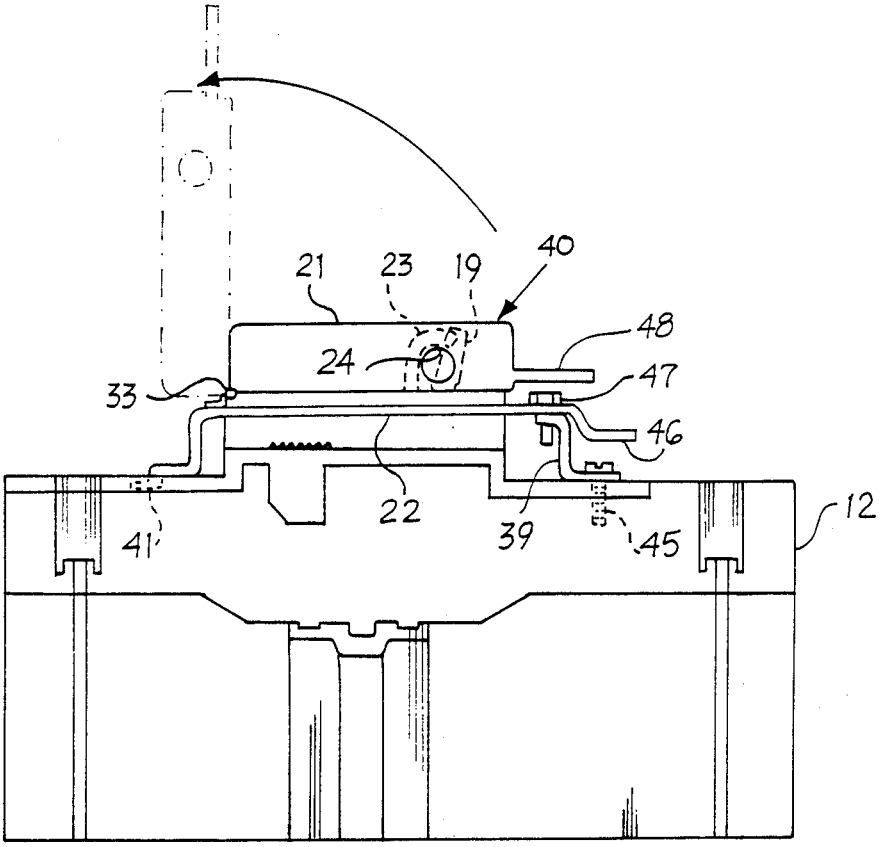
FIG. 3 is a side view of the circuit breaker shown in FIG. 1 with an alternate arrangement of a circuit breaker handle interlock in accordance with the invention.

The operating handle interlock system 20 is depicted in FIG. 2 prior to attachment to the circuit breaker cover by inserting a pair of offset tabs 41, 42 within a corresponding pair of slots 43, 44 within the accessory cover 13 and thereafter fastening the support base 22 to the accessory cover by means of screw 49, thru-hole 30, and threaded aperture 27. The operating handle 19 operatably extends upwardly through the rectangular slot 31 formed within the support base. The operating handle cover 21 is attached to the support base by means of a hinge 33. The second aperture 34 is shown in alignment with aperture 24 and is arranged such that both apertures align with the locking hasp 23 to thereby allow the placement of the padlock arm 26 shown earlier in FIG. 1 through the apertures 24, 34 and through the radial opening 38 formed under the locking hasp. An optional Z-shaped leaf spring 35 which is attached to the operating handle cover 21 by means of one offset end 37 is arranged such that the other offset end 36 and spring tabs 36A, 36B interfere with the padlock arm when the operating handle is in the ON position indicated in phantom. The spring allows a wide tolerance between the location of the apertures 24, 34 along the cover 21 and also permits different sizes of padlocks or other locking devices. It is noted that when the operating handle is in the ON position, the operating handle to be used interfaces the apertures 24, 34 and thereby prevents the padlock arm from passing from one aperture to the other and hence prevents the circuit breaker from being locked in its ON condition. The support base 22 which is formed from a sheet metal plate, is formed into a platform 32 with a forward step 28 which contains the thru-hole 30 and a rear step 29 which contains the offset tabs 41, 42. Comparing FIGS. 1 and 2, it is noted that the circuit breaker operating handle cover can be closed when the circuit breaker operating handle 19 is in the OFF position out of interference between the apertures and the padlock arm. The operating handle in the ON position indicated in FIG. 2 prevents the insertion of the padlock arm through the apertures in the operating handle cover and thereby prevents the circuit breaker from being locked in its ON condition. In order for the device to be completely secure, whereby access to the attaching screw is prevented when the operating handle is padlocked in its OFF position, the length of the handle cover 21 is extended over the screw 49 to thereby prevent removing the screw and summarily lifting the support base 22 from the circuit breaker for access to the circuit breaker operating handle 19. Referring to the operating handle interlock system 40 of FIG. 3, a Z-shaped bracket 39 is fastened to the circuit breaker cover 12 by means of a screw 45 at one end and is attached to the upstanding bracket 46 formed within the support base 22 by means of a bolt 47. When the handle cover 21 is in its closed position over the operating handle 19, the tab 48 extending from the handle cover extends over the bolt 47 to thereby prevent access to the bolt for removal purposes. The opposite end of the support base 22 is attached to the circuit breaker cover by means of the pair of offset tabs, one of which is shown at 41. When the handle cover 21 is rotated to its open position about hinge 33 as indicated, the operating handle 19 is accessible thereby allowing the circuit breaker to be turned to its ON and OFF conditions. With the handle cover 21 in its closed position and with the operating handle 19 in its ON position, as indicated in solid lines, it is noted that the operating handle then aligns with the aperture 24 and locking hasp 23 and thereby prevents the insertion of a padlock arm in the manner described earlier with reference to FIGS. 1 and 2. Referring again to FIG. 2, it is further contemplated that the accessory cover 13 can be eliminated and the accessory compartment doors 14, 15 and rating plug recess 16 can be incorporated with the support base 22, as indicated at 13' in phantom. The support base would then be attached directly to the underlying circuit breaker cover 12 by means of the additional thru-holes 50, 51.

In some Applications, such as when providing emergency power to medical equipment, computers and the like, it is necessary to lock the circuit breaker operating handle in its ON position and therefore prevent access to the operating handle. To determine whether the operating handle position is a true indication of whether the circuit breaker contacts are either open or closed, the operator should view the actual contact condition viewed by means of the viewing window shown earlier. Referring again to FIG. 1, it is noted that the aperture 24' and hasp 23' are arranged for locking the operating handle in the ON position. To facilitate indication of the operating handle position, the cover 21 can be fabricated from a transparent plastic material such as Lexan which is a registered trademark of GE Company for polycarbonate. This improves over locking the operating handle in its ON position which could prevent the circuit breaker from responding to overcurrent conditions.

A circuit breaker handle interlock arrangement has herein been described whereby the circuit breaker handle can only be locked in its OFF position if the circuit breaker contacts are separated. The welded circuit breaker contacts automatically return the operating handle to its ON position to thereby prevent locking of the circuit breaker handle in its ON position when the circuit breaker contacts are closed or when they are welded together.

Having thus described our invention, what we claim as new and desire to secure by Letters Patent is:

1. A circuit breaker operating handle interlock arrangement comprising:

a support base adapted to be attached to a top surface of a molded case circuit breaker proximate a circuit breaker operating handle having ON and OFF positions on said top surface;

a circuit breaker operating handle enclosure consisting of a top having a pair of depending sides arranged for preventing access to said operating handle, said handle enclosure being pivotally attached to said support base; and a locking hasp upstanding from said support base and aligned with a pair of opposing apertures, one through each of said sides, said apertures being arranged on an end of said handle enclosure proximate said ON position.

2. The interlock arrangement of claim 1 wherein said locking hasp is formed within said support base.

3. The interlock arrangement of claim 1 wherein said locking hasp comprises a hook-shaped end arranged for receiving a padlock.

4. The interlock of claim 3 including means within said enclosure extending from said top and interfacing between said opposing apertures to thereby prevent insertion of said padlock.

5. The interlock of claim 4 wherein said interfering means comprises a spring.

6. The interlock of claim 5 wherein said spring comprises a Z-shaped configuration with one end arranged against said top and an opposite end facing said operating handle.

7. The interlock of claim 1 including means for fastening said support base to said top surface.

8. The interlock of claim 7 wherein said handle enclosure extends over said fastening means to thereby prevent access to said fastening means.

9. The interlock of claim 7 including a Z-shaped attachment bracket intermediate said top surface and said handle enclosure.

10. The interlock of claim 7 wherein said handle enclosure includes means extending from one end of said handle enclosure over said fastening means to thereby prevent access to said fastening means.

11. The interlock of claim 1 including an accessory door integrally-formed with said support base.

12. The interlock of claim 1 further including a rating plug recess formed in said support base.

13. The interlock of claim 1 wherein said enclosure comprises a transparent plastic.

14. The interlock of claim 6 wherein said opposite end includes an upstanding tab, arranged intermediate said opposing aperture.

15. The interlock of claim 3 wherein said opposing apertures are arranged on either side of said operating handle when said handle is in said ON position to thereby prevent insertion of said padlock when said operating handle is in said ON position.

16. The interlock of claim 3 wherein said apertures are arranged ahead of said operating handle when said operating handle is in said ON position to thereby allow insertion of said padlock when said operating handle is in said ON position.

* * * * *